US007600757B1

(12) United States Patent
Matilla et al.

(10) Patent No.: US 7,600,757 B1
(45) Date of Patent: Oct. 13, 2009

(54) BOARD GAME

(75) Inventors: Kimberly V. Matilla, Echo Park, CA (US); Stephen Pang Kwai Lau, Torrance, CA (US); Sammy Wai Nang Lam, Kowloon (HK); Eric C. Ostendorff, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/903,200

(22) Filed: Sep. 19, 2007

Related U.S. Application Data

(60) Provisional application No. 60/846,008, filed on Sep. 19, 2006.

(51) Int. Cl.
*A63F 3/00* (2006.01)

(52) U.S. Cl. ..... 273/241; 273/287

(58) Field of Classification Search ..... 273/241, 273/285, 286, 287, 276; 446/330, 331, 332, 446/1, 2, 9

See application file for complete search history.

(56) References Cited

U.S. PATENT DOCUMENTS

| | | | |
|---|---|---|---|
| 1,953,631 | A | 4/1934 | Pritzkow |
| 2,454,639 | A | 11/1948 | Edwards |
| 3,298,692 | A | 1/1967 | Glass et al. |
| 3,300,891 | A | 1/1967 | Glass et al. |
| 3,649,021 | A | 3/1972 | Hayes |
| 3,888,488 | A | 6/1975 | Sims |
| 4,057,254 | A | 11/1977 | Girres |
| 4,089,529 | A | 5/1978 | Usami |
| 4,128,246 | A | 12/1978 | Hicks et al. |
| 4,219,198 | A | 8/1980 | Meyer et al. |
| 4,290,605 | A | 9/1981 | Matsumoto |
| 4,308,647 | A | 1/1982 | Gillis |
| 4,348,028 | A | 9/1982 | Barlow |
| 4,484,747 | A | 11/1984 | Breslow et al. |
| 4,575,094 | A | 3/1986 | Ferris et al. |
| 4,708,348 | A | 11/1987 | Zaruba et al. |
| 4,824,117 | A | 4/1989 | Russell |
| 4,852,886 | A | 8/1989 | Zaruba et al. |
| 4,979,749 | A | 12/1990 | Onanian |
| 5,211,403 | A | 5/1993 | Ostrander |

(Continued)

OTHER PUBLICATIONS

"Rumble in the Jungle" by Tomy 2004; www.idealgiftbox.com/item581.htm; 3 pages.

(Continued)

*Primary Examiner*—Vishu K. Mendiratta
(74) *Attorney, Agent, or Firm*—Edell, Shaprio & Finnan LLC

(57) ABSTRACT

A game playset includes at least one movable game piece object for a player to advance during game play. It also includes a game board which has a path provided thereon across which the at least one movable game piece object advances. The game board also including a plurality of components attached to a surface of the game board, and each of the plurality of components is pivotably mounted and has a manual trigger associated therewith. So when a first of the plurality of components pivots downwardly in a falling motion, it comes into contact with a corresponding trigger associated with a second of the plurality of components, thereby causing the second of the plurality of components to pivot downwardly by falling.

18 Claims, 9 Drawing Sheets

U.S. PATENT DOCUMENTS

| | | | |
|---|---|---|---|
| 5,240,255 | A | 8/1993 | Barlow |
| 6,718,600 | B1 | 4/2004 | Gillis |
| 6,871,853 | B2 | 3/2005 | Bedford |
| 6,923,407 | B2 | 8/2005 | Takeuchi |
| 7,082,650 | B2 | 8/2006 | Awakura et al. |
| 2006/0145421 | A1 | 7/2006 | Yu et al. |

OTHER PUBLICATIONS

"Mouse Trap" by Ideal; www.hasbro.com/default.cfm?page=browse& product_id=9461.

BOARD GAME

CROSS-REFERENCE TO RELATED APPLICATION

This application claims priority to U.S. Provisional Patent Application No. 60/846,008 filed on Sep. 19, 2006 entitled "BOARD GAMES WITH SEQUENTIALLY ACTUABLE COMPONENTS", the entire contents of which are incorporated herein by reference in their entirety for all purposes.

BACKGROUND

The present disclosure is directed to board games, and more particularly to board games incorporating the use of three-dimensional structural components detachably interlocked to a game board and operatively associated in a series so that each actuates another to provide a sequence of events terminating in a particular desired result.

SUMMARY

In some embodiments, the various structural components may include a trip unit adapted to start a sequence in which each of a series of structural components are consecutively and automatically actuated in a predetermined order. In such embodiments, the trip unit may include a user-operable trigger and a random actuation mechanism so that user operation of the trigger may or may not result in actuation of the trip unit to start the sequence. In these embodiments, such a sequence may culminate in the actuation of a terminating unit.

In some embodiments, the game board may include a plurality of shaped sockets or openings, at which the various structural components may be detachably interlocked via a connector device. Such a connector device may consist essentially of a short, hollow cylinder extending vertically from a flat base, with engaging structure adapted to form a snap fit or friction fit with the game board. Thus secured, the connector device may cooperate with a base portion of a structural component to provide a detachable interlocking mechanism by which the various components may be secured to the game board in a position so as to make the entire assembly operable in a desired manner.

In some embodiments, the game board and one or more components may include movement spaces arranged to form a pathway, positioned relative to the components such that actuation of one or more of the components may disrupt or dislodge a player mover situated on a predetermined movement space. Some embodiments may further include various chips or tokens, and player movers adapted to hold or otherwise releasably retain one or more tokens. In such embodiments, the player movers may be adapted to drop or release a held token, for example, if the player mover is suddenly dislodged from a movement space.

Methods of game play suitable for use with such embodiments may involve one or more players attempting to collect and thereafter "deliver" a predetermined number or set of tokens to a destination space or to a designated structural component. Upon the occurrence of certain random and/or predetermined game events during game play, such as selecting a certain token or moving a player mover to a certain movement space or the like, a player may operate the trigger on a trip unit one or more times. If the trip unit actuates a sequence in which each of a series of structural components are consecutively and automatically actuated in a predetermined order, a penalty may be assessed if a player mover is thereby dislodged and/or if a player mover releases a token it is carrying. The penalty may be retrograde movement of the dislodged player mover to a "safe" movement space, requiring the player mover to collect an additional token, return of any "dropped" tokens to a token collection area, and so forth.

In some embodiments, a terminating unit may be configured to launch one or more delivered tokens toward a target. The goal of game play may in such embodiments may be to deliver tokens and thereafter trigger the aforementioned sequential operation of structural components to culminate in launching delivered tokens toward the target.

A game playset includes at least one movable game piece object for a player to advance during game play. It also includes a game board which has a path provided thereon across which the at least one movable game piece object advances. The game board also including a plurality of components attached to a surface of the game board, and each of the plurality of components is pivotably mounted and has a manual trigger associated therewith. So when a first of the plurality of components pivots downwardly in a falling motion, it comes into contact with a corresponding trigger associated with a second of the plurality of components, thereby causing the second of the plurality of components to pivot downwardly by falling. The plurality of components can be mounted to the game board by a connector device attached to a hole in the game board. Also, the plurality of components are in the shape of a kitchen utensil which can be anything commonly found in a kitchen, including but not limited to food items such as bread, textiles such as dish towels, or salt or pepper shakers. The path of the game board may be at least partially formed across at least one of the plurality of components, like the top surface of a loaf of bread.

Examples of construction and amusement devices consisting of a series of operatively associated structural components can be found in the disclosures of U.S. Pat. Nos. 3,300,891 and 4,219,198. Examples of board games incorporating such devices can be found in the disclosures of U.S. Pat. No. 3,298,692 (and the corresponding commercial game "Mouse Trap" first produced by Ideal in 1963), U.S. Pat. Nos. 4,290,605, 4,348,028, and the game "Rumble in the Jungle" produced by Tomy Corporation in 2004. Examples of games utilizing one or more mechanical devices to disrupt player movers on a pathway can be found in U.S. Pat. Nos. 3,649,021, 4,484,747 and 4,852,886. Examples of devices adapted to removably interlock with a surface can be found in the disclosures of U.S. Pat. Nos. 4,308,647, 6,718,600, 6,923,407, and 7,082,650. Examples of board games incorporating such devices can be found in the disclosures of U.S. Pat. Nos. 2,454,639, 3,888,488, 4,057,254, and 4,708,348. The disclosures of all of the aforementioned references are incorporated herein by reference in their entirety for all purposes.

The games of the present disclosure may be understood more readily after a consideration of the drawings and the Detailed Description.

DETAILED DESCRIPTION

Figure 1:
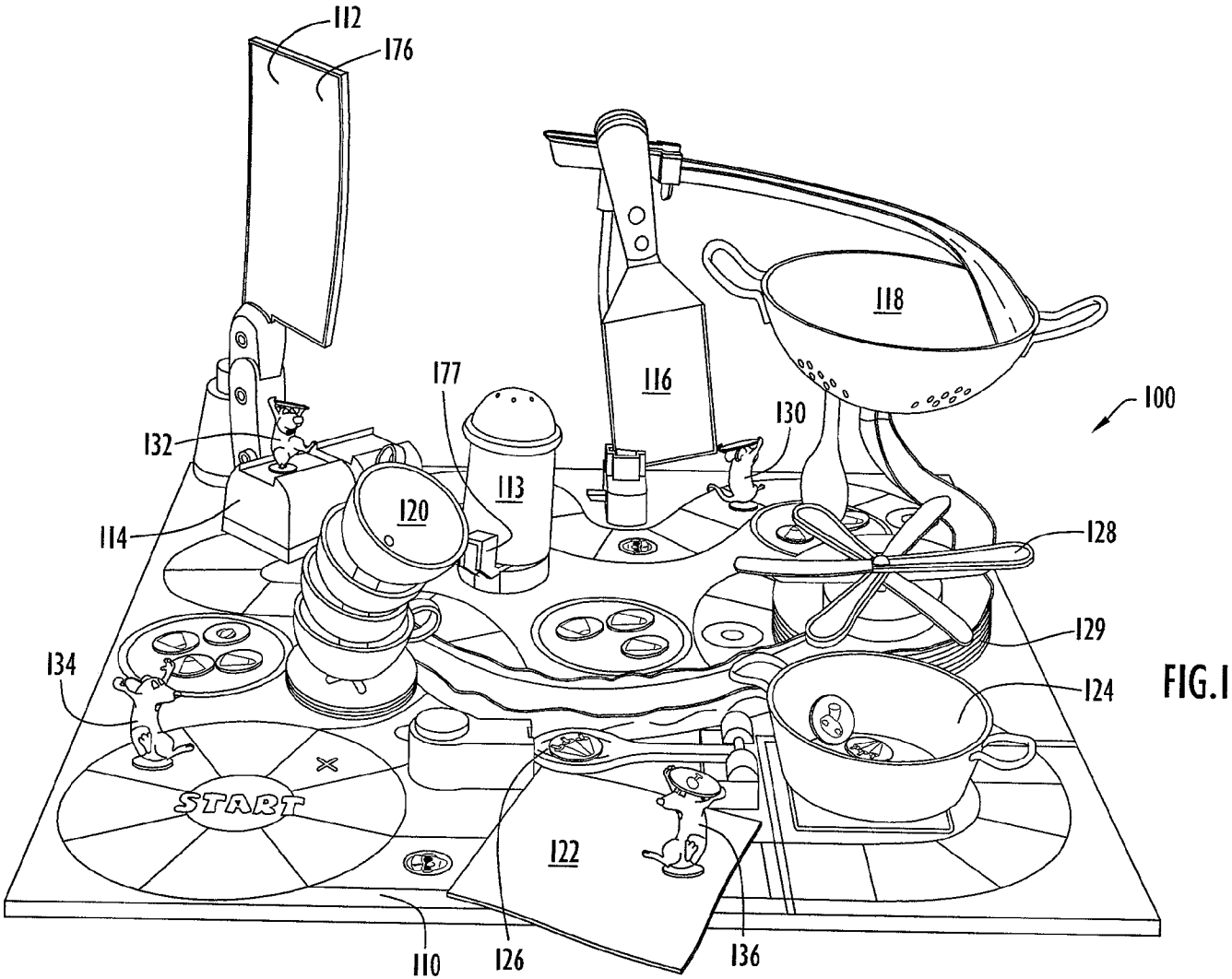
FIG. 1 is a front perspective view of an exemplary embodiment of a board game according to the present disclosure that includes a game board, several three-dimensional structural components in the form of various kitchen utensils attached thereto, a plurality of player movers arranged on a pathway formed by movement spaces on the game board and structural components, and several groups of tokens located in token collection spaces on the game board. Three of the player movers are each shown to have a token removably mounted thereon.

An exemplary board game apparatus 100 (or action playset) is shown in FIG. 1 to include a generally flat game board 110, several three-dimensional structural components in the form of various kitchen utensils attached thereto, a plurality of colored player movers, and several groups of tokens.

Figure 2:
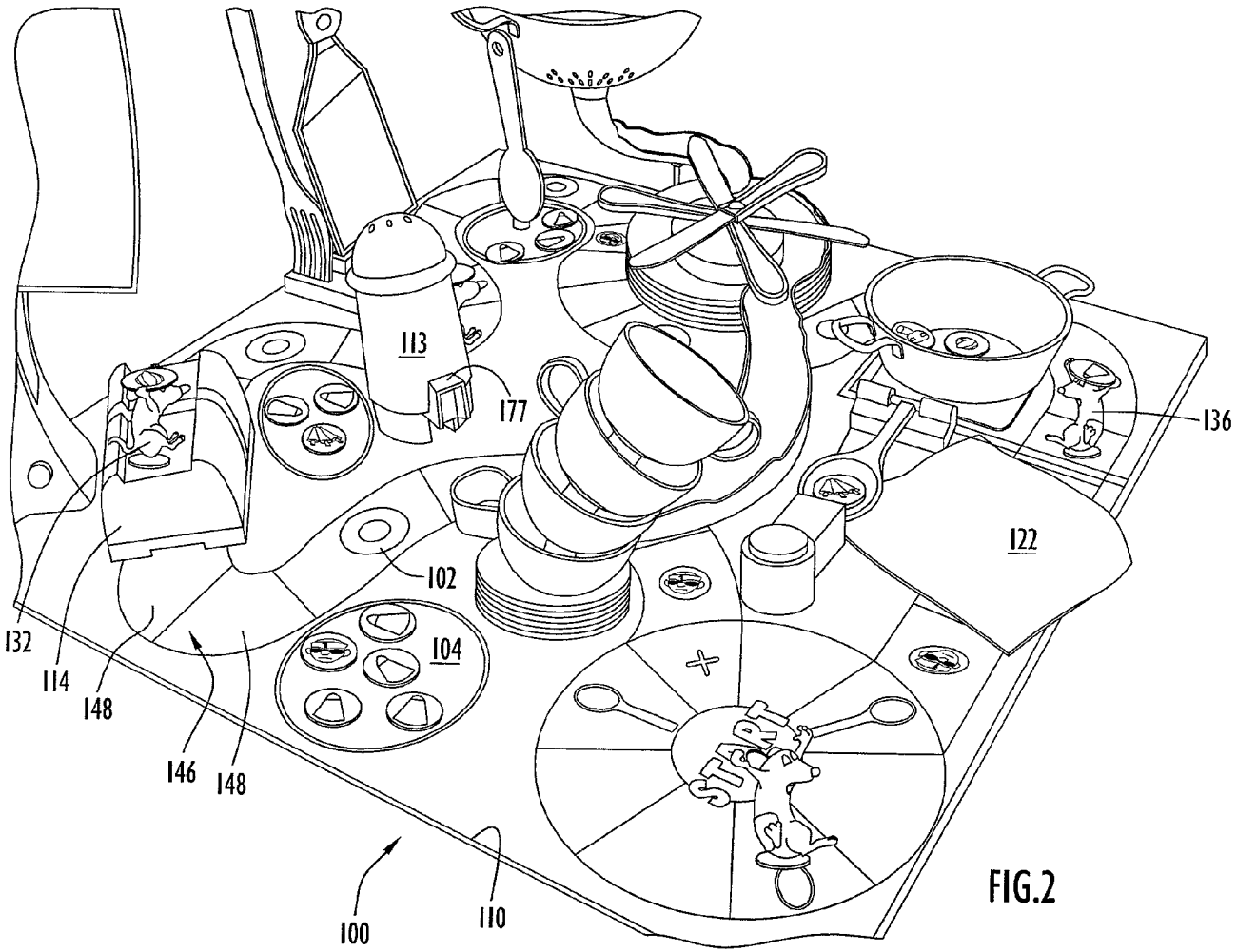
FIG. 2 is a corner perspective view of an alternative embodiment of a game board with structural components.
Figure 3:
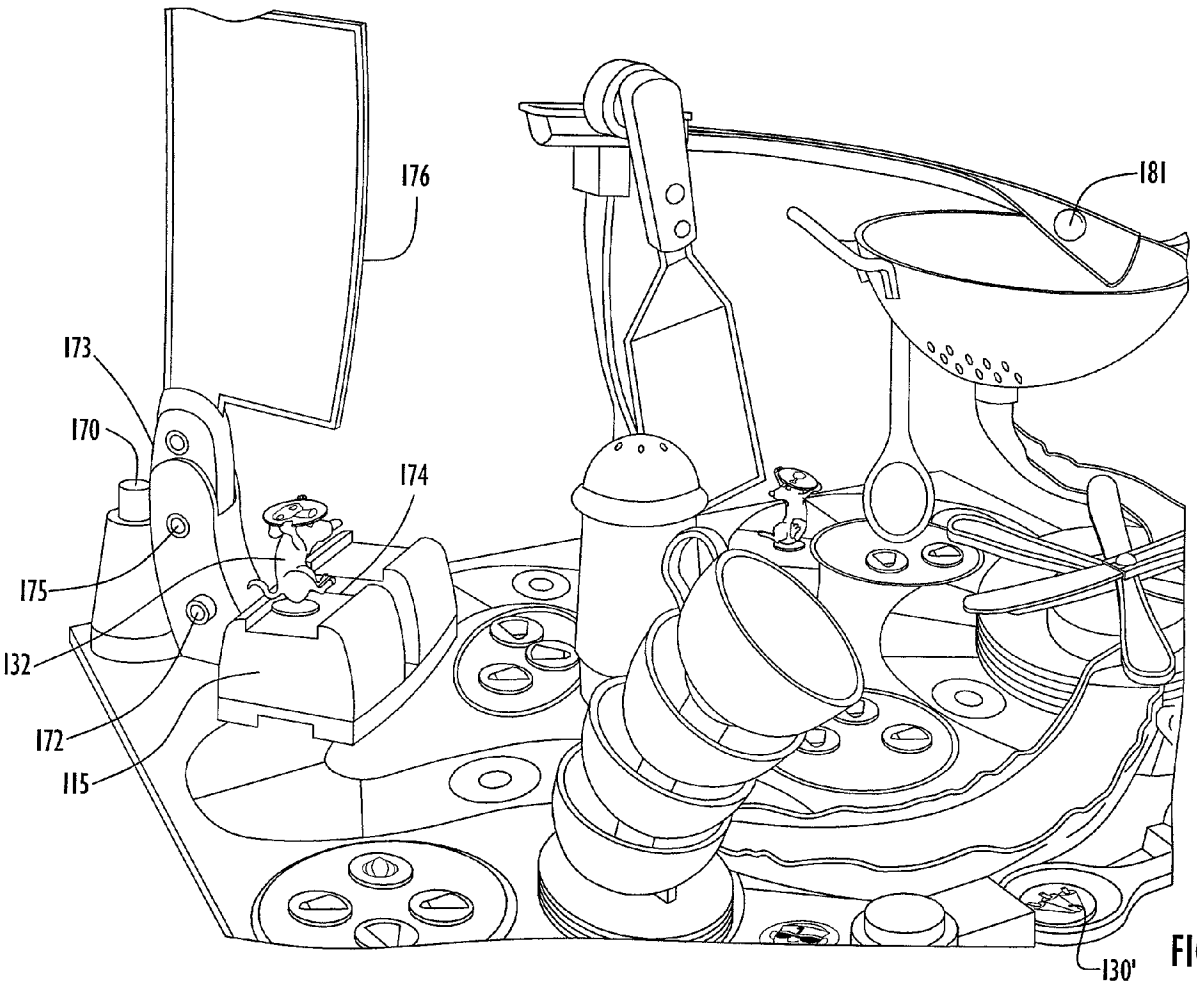
FIG. 3 is another close-up perspective view of the embodiment of FIG. 1, showing a trip unit structural component in greater detail.
Figure 4:
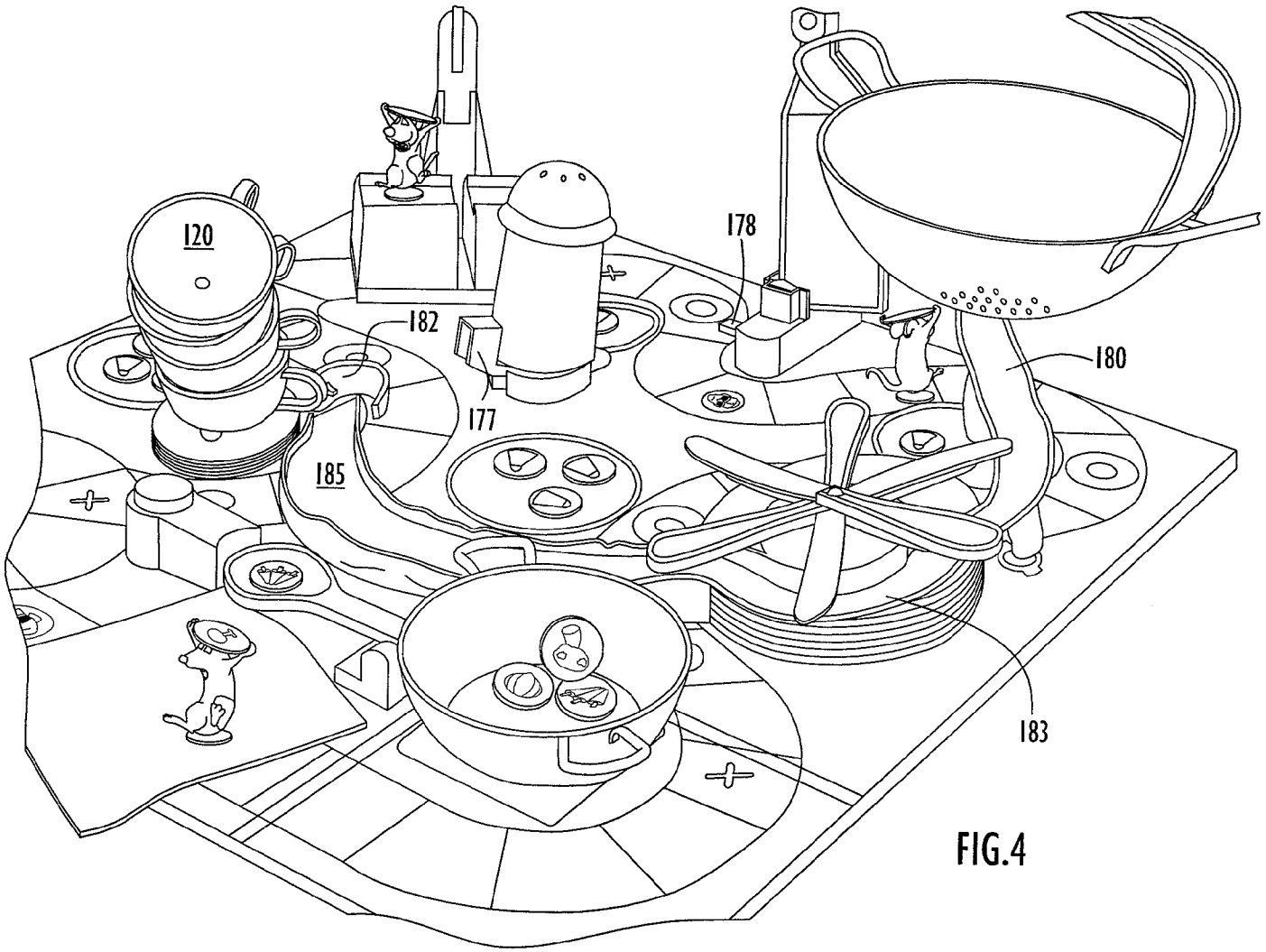
FIG. 4 is another close-up perspective view of the embodiment of FIG. 1, showing a terminating unit structural component in greater detail.
Figure 5:
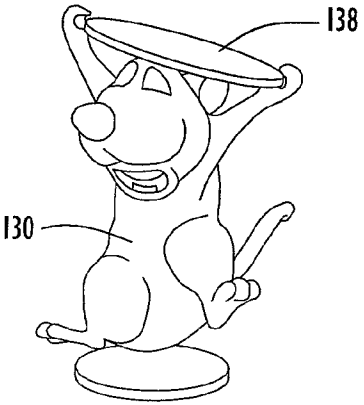
FIGS. 5-8 are several views of an exemplary player mover similar to those in the embodiment of FIG. 1, with a token removably mounted thereon.
Figure 6:
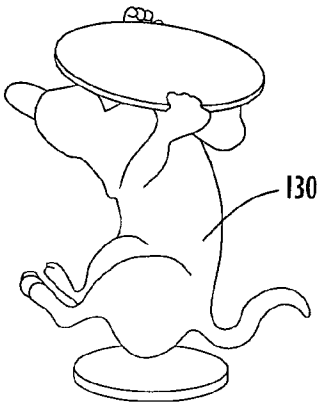
Figure 7:
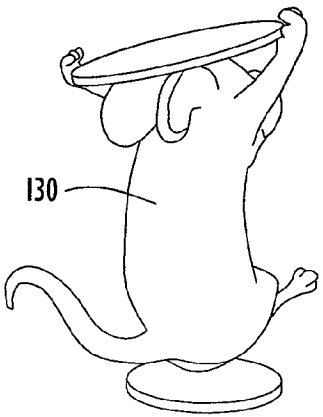
Figure 8:
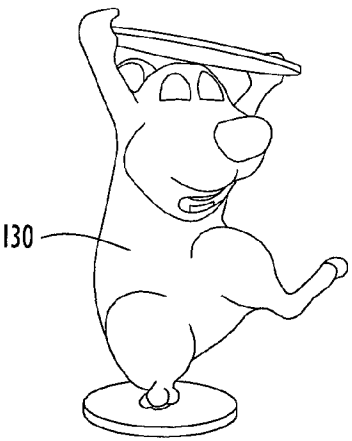
Figure 9:
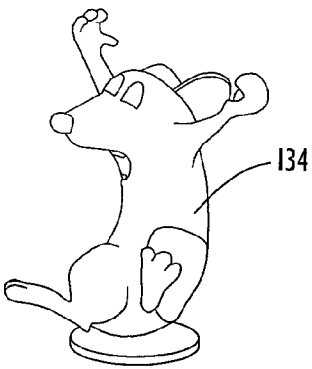
FIG. 9 is another view showing one of the player movers of the embodiment of FIG. 1 in greater detail. This player mover is shown not holding a token.
Figure 10:
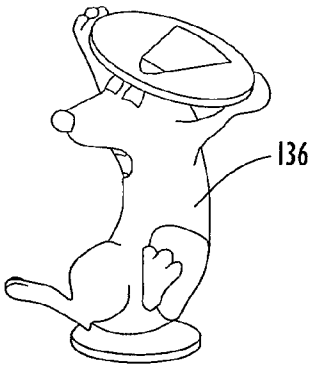
FIG. 10 is still another view of the player movers of the embodiment of FIG. 1 in greater detail. This player mover is shown holding a token.

As seen in FIG. 1 and also in FIGS. 2-4, the exemplary game board 110 is shown to include a circuitous pathway 140 formed by a plurality of adjacent movement spaces 148. The pathway 150 describes a large, closed loop that meanders generally around the periphery of the game board and among the various structural components, and includes a smaller loop of movement spaces that may be used as a starting area in some game play methods, as explained in greater detail below. Portions of the pathway traverse some of the structural components; a red colored player mover 132 is shown to be positioned on a movement space atop a structural component in the form of a loaf of bread 114, and a blue colored player mover 136 is shown adjacent to a napkin or dish-towel-like component 122 that lays across a portion of the game board. Other portions of the pathway are shown to run beneath some of the structural components. However, the pathway and movement spaces may take any suitable configuration.

Also, some of the movement spaces are shown to include various distinctive indicia, which may be used during game play to indicate a game action to be taken by a player when a player mover is moved to occupy one of such movement spaces. For example, token indicia (shown as a graphic image of a plate 102) may indicate that a player may collect a token 138 from a nearby token collection area (which are shown to be graphic-images, shaped like plates 104). Such game actions may relate to the game play methods used with the game board, some of which are explained in greater detail below, and thus the various indicia on the movement spaces may vary as desired.

The movement space indicia, and other decorative and/or functional indicia of the various game components, may also relate to a theme or backstory incorporated into the game. For example, the various embodiments shown in the figures and discussed herein are based on the Disney/Pixar animated motion picture "RATATOUILLE." In the film, a rat named Remy aspires to become a great French chef, and attempts to sneak into the kitchen of a restaurant to practice cooking. However, one of the restaurant's cooks, Chef Skinner, repeatedly chases Remy out of the kitchen. As such, various aspects of embodiments that incorporate this theme reflect elements of the film. For example, all of the structural components of the exemplary embodiments are in the form of kitchen utensils and related items, the player movers are shown to resemble the Remy rat character, the tokens visually represent various food items, and so forth. However, alternative embodiments may incorporate one or more other themes, or no theme, as desired.

Interspersed among the various structural components on the game board 110 are several token collection areas, shown to be shaped like plates 104. A set of tokens 138, 140, 142, 144, is shown to placed in each token collection area. The tokens 138 are shown as flat, two-sided discs, one side of which bears a graphic image of a food item or an image of the Chef Skinner character, and the other side bears generic and/or trade dress indicia. As such, the tokens are indistinguishable when placed with the generic side facing up. In the exemplary embodiments, each food item is color-coded, such that each of four colors is visually associated with each of four food ingredients. In FIG. 4, three differently colored tokens, representing three different food ingredients, are shown in a structural component resembling a cooking pot 124. However, other configurations of tokens and token collection areas are within the scope of this disclosure.

As shown in FIGS. 1-4 and in greater detail in FIGS. 5-10, the player movers each resemble a rat figure posed with two "hands" raised above its head. Each player mover is thus adapted to have a token removably mounted thereto, as shown in FIGS. 5-8 and FIG. 10. As such, the player movers are configured to appear to be precariously "carrying" a mounted token by gripping it overhead. Each player mover's hands, or other structure adapted to removably receive a token, may be configured to hold a token with a desired degree of force. For example, in the exemplary embodiment, the mounting structure is configured to allow easy insertion and removal of a token from a player mover, such as by a player during game play, and/or to allow the player mover to "drop" a mounted token if the player mover is suddenly bumped or dislodged, or tipped over. Also, although the player movers shown are configured to hold only one token at a time, the player movers may be adapted to carry any number and/or shape of token.

The player movers are shown to be distinguishable by color; each player mover in FIGS. 1-4 correspond to one of the colors used to distinguish the various food ingredient tokens. As such, each player mover of the illustrated embodiment corresponds to a set of similarly colored tokens. Other embodiments may employ a different correspondence, or no correspondence, as desired.

The various structural components shown mounted to the game board 110 are relatively positioned with respect to each other, and operatively associated in a series, so that each structural component automatically and sequentially actuates the next in the series so that the entire apparatus culminates in a desired result. The components may take a variety of shapes and configurations, such as those of kitchen utensils and related items, and may be adapted to be detachably interlocked with the game board.

Figure 11:
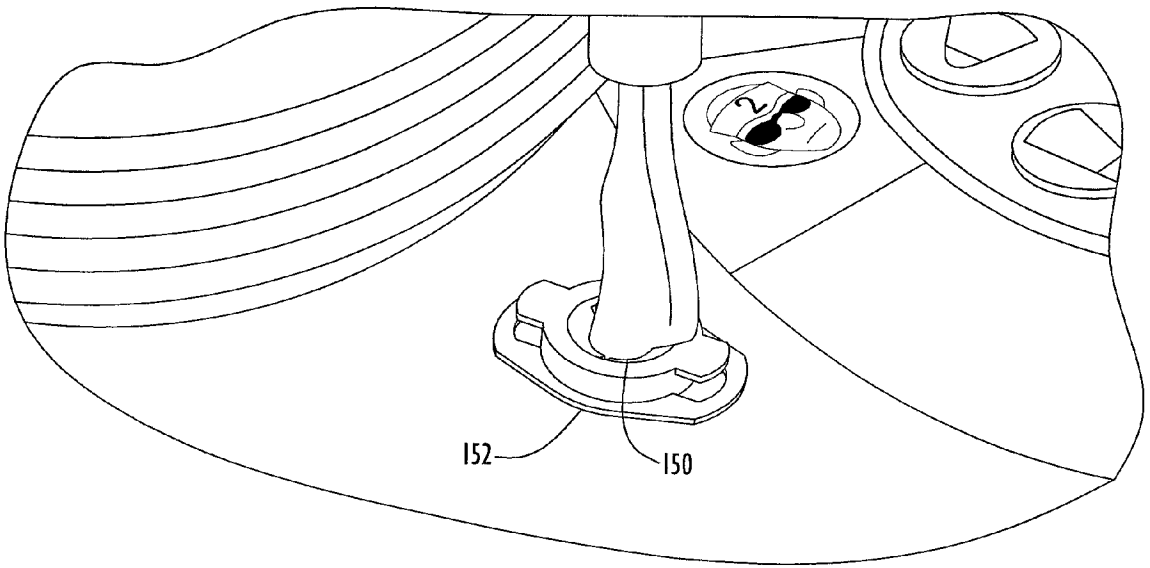
FIG. 11 is a magnified view of the embodiment of FIG. 1, showing how the base portion of a structural component is detachably interlocked with the game board via a connector device.
Figure 12:
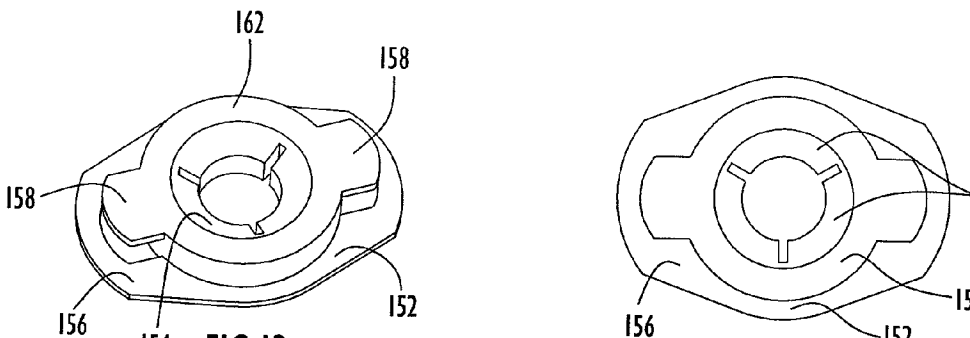
FIG. 12 is a magnified view showing a perspective view of an exemplary connector device of the embodiment of FIG. 1.
Figure 13:
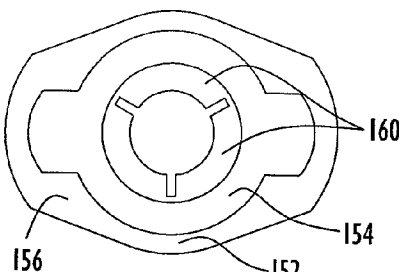
FIG. 13 is a magnified view showing a top view of an exemplary connector device of the embodiment of FIG. 1 and FIG. 11 and FIG. 12.

FIG. 11 shows a base portion 150 of one of the structural components that is detachably interlocked with the game board via a connector device 152, which is shown in greater detail in FIGS. 12 and 13.

As shown, the exemplary connector device 152 is shown to consist essentially of a short, hollow cylinder 154 extending vertically from a flat base 156, with fins 158 extending horizontally from a top end of the cylinder. There are flexible ribs 160 on the interior surface of the cylinder. The footprint of the top end 162 of the connector is smaller than the footprint of the base 156.

In use, a connector device 152 is placed through an opening in a game board that is roughly the same size and shape of the smaller footprint. For example, as shown in FIG. 11, a connector device may be inserted through an opening in the game board from the bottom surface. The connector device is then turned so that the fins 158 and base 156 make a friction fit with the top and bottom surfaces of the game board 110, securing the connector device 152 in place.

An alternative snap-fit design may operate in essentially the same manner, but may be inserted through an opening in the game board 110 by pinching flexible vertical fins inward prior to insertion. The connector device 152 may then be secured to the game board 110 by the vertical fins pressing against the sides of the opening, rather than by a friction fit with the top and bottom surfaces of the game board 110.

Thus secured, a connector device 152, or more specifically the interior ribs 160 (and/or other structure) thereof, may cooperate with a base portion of a structural component to provide a detachable interlocking mechanism by which the various components 112, 116, 118, etc, may be secured to the game board 110.

The manner of securing the structural components to the game board may be done so as to ensure that the actuation of each component will succeed in triggering the automatic actuation of the next component. Optionally, some embodiments of the game may be configured to incorporate the possibility that one or more components fail to actuate in series. In some commercial embodiments of the game, the connector devices and structural components may be provided as preassembled units, or a set of instructions accompanying the game may provide user instructions for assembling the apparatus.

In the pictured embodiments, the various structural components collectively form an apparatus that operates in a predetermined sequence, with each structural component configured, both in position and in function, to actuate the next in the series.

More specifically, the first structural component of the series which collectively form the actuable apparatus, which may be thought of as a trip unit, includes a user-operable trigger and a random actuation mechanism so that user operation of the trigger may or may not result in actuation of the trip unit to start the sequence. The final structural component analogously may be thought of as a terminating unit.

As such, each structural component includes at least one actuable mechanism, which may take any suitable form, and an actuating device or trigger that actuates the at least one actuable mechanism of the component. For example, the trip unit is shown as a large cleaver-type knife 112, oriented vertically so that it appears to be balanced on its handle 173. As seen in greater detail in FIG. 3, the handle is hinged 175 to allow the knife blade 176 to pivot downwardly and fall generally toward the center of the game board 110 when the trip unit is actuated. The handle may include a spring or other biasing member configured to urge the blade downward, such that the trip unit may be actuated by moving an internal stop member or other structure to allow the blade to fall. The base of the trip unit includes a user-operable trigger in the form of a button 170, which is connected to an internal random actuation mechanism so that operation of the trigger may or may not actuate the trip unit. Any suitable random actuation mechanism may be used. The base also includes an override button 172 configured to bypass the random actuation mechanism and actuate the trip unit.

Positioned adjacent to the trip unit is a structural component shaped to resemble a loaf of bread 114. As mentioned above, a portion of the pathway 115 traverses this component, and FIGS. 1-4 show that a red colored player mover is positioned on the pathway atop the loaf of bread. This component includes a slot 174 shaped to receive the blade of the knife 176, and a trigger mechanism that urges the portions of the loaf of bread on either side of the slot to spring apart when the trigger mechanism is contacted by the blade of the knife. A player mover 132 positioned on one of the movement spaces atop the loaf of bread may thus be flung off, or otherwise dislodged, when this component is actuated.

Near the loaf of bread 114 is a structural component in the form of a salt shaker 113. In FIG. 4, the base of the salt shaker 113 can be seen to include a projecting tab 177 that may act as a release or trigger, and which is positioned to be engaged by the blade of the knife 176 when the trip unit is actuated. When the tab is struck by the knife blade, a biasing member or other suitable means within the salt shaker component 113 tips the component to one side, giving the appearance that the salt shaker 113 falls and pivots downward by being is knocked over by the knife.

Located across a section of pathway from the salt shaker component 113, and best viewed in FIGS. 3-4, is a structural component in the form of a vertically oriented spatula 116 that appears to be balanced on its blade. In FIG. 4, the base of this component also includes a small projecting tab 178 which, when pressed, swings the spatula blade upward and away from the base. Actuation of this component also releases a small ball bearing from the end of the handle of the spatula component.

A curved ramp operatively connects the spatula component 116 with a structural component in the form of a strainer 118. A ball bearing 181 released down the ramp will engage and circle the hemispherical interior surface of the strainer until exiting an opening located in the bottom.

As seen in FIG. 4, another shaped ramp 180 connects the strainer 116 to the next structural component, which resembles a short stack of dishes 129 with three butter knives 128 positioned at the top of the stack. The knives are positioned so that each handle and blade radiates outward from a pivotable center portion. Each radiating knife section includes a small, downwardly depending tab so that when a knife section overhangs the portion of the ramp 183 proximate the stack of dishes 129, one or more tabs is placed within the path of a ball bearing rolling down the ramp. When thus engaged by a rolling ball bearing, the knives 128 will pivot atop the stack of dishes 129.

The pathway of movement spaces is shown to follow the periphery of the stack of dishes 129, and the knives are positioned to extend into the space above the pathway, such that a player mover positioned on one of the movement spaces adjacent the stack of dishes may be moved or dislodged by the spinning knives 128 when this structural component is actuated.

Another length of shaped ramp operatively connects the stack of dishes to a structural component in the form of a leaning stack of cups 120. The ramp 185 is shown to terminate in a small collection area that includes a trigger 182 that actuates the stack of cups component 120, such as when a ball bearing rolls down the ramp into the collection area and strikes the trigger. When actuated, the stack of cups 120 appears to fall pivoting downwardly in the direction that the stack is shown to lean.

A terminating unit is shown in FIG. 4 to resemble a spoon 126, which is connected to a piece of material shaped to resemble a dish towel 122, shown to lie across a portion of pathway. The head of the spoon is shaped to receive one or more tokens 130, and is biased to spring upwards in an arc, launching any tokens in the head of the spoon toward a target area in the form of a cooking pot 124. The towel 122 is attached to the head of the spoon, and thus is suddenly drawn upwards when the spoon component is actuated, dislodging or overturning any player movers positioned on the napkin. The spoon component includes a trigger in the form of a round button 184 that is positioned underneath the path of falling stack of cups 10, and is thus actuated when the stack of cups "falls."

Thus described, the sequential actuation of the series of structural components of the exemplary embodiment may be triggered by actuation of the trip unit and may culminate in launching one or more tokens into the cooking pot 124.

Figure 14:
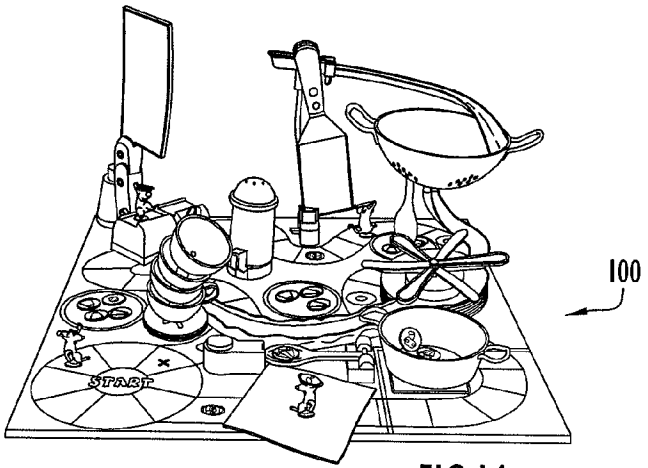

This sequence is visually depicted in FIGS. 14-24, which is a series of video captures. FIG. 14 shows the apparatus play set 100 prior to actuation of the trip unit.

Figure 15:
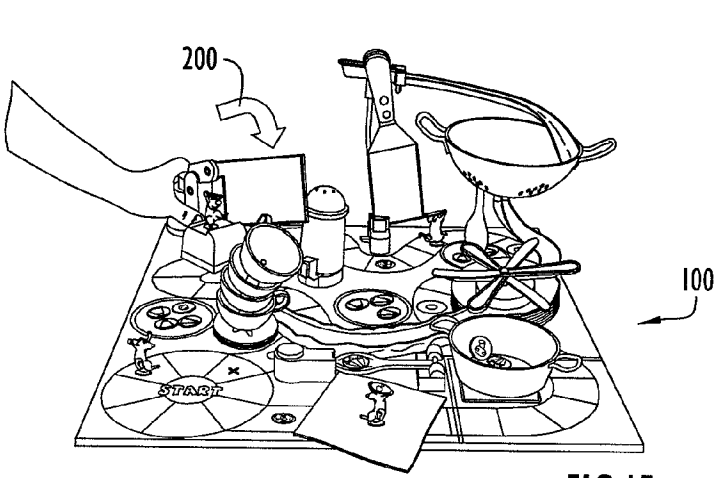
FIGS. 14-24 are a series of video captures of the embodiment of FIG. 1, showing how actuation of the trip unit begins a sequence in which each of the series of structural components are consecutively and automatically actuated in a predetermined order, dislodging player movers on the game board and culminating in launching tokens toward a target.

FIG. 15 shows a user actuating the trip unit by operating the override button on the base of the trip unit, allowing the knife blade 176 to fall downward into the loaf of bread component 114, as indicated by arrow 200.

Figure 16:
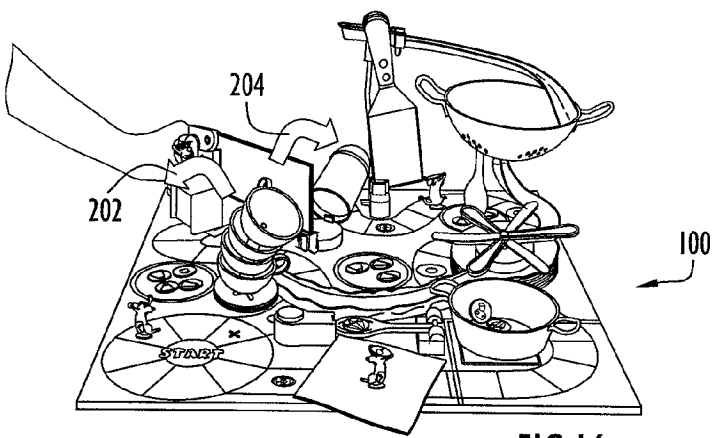

In FIG. 16, the two halves of the loaf of bread spring apart as indicated by arrows 202 and 204, flinging the red player mover 132 away from the game board 110 (and dislodging the token 130 mounted to the player mover). The knife blade 176 engages the tab on the base of the salt shaker 113, causing the salt shaker to fall toward the spatula component.

Figure 17:
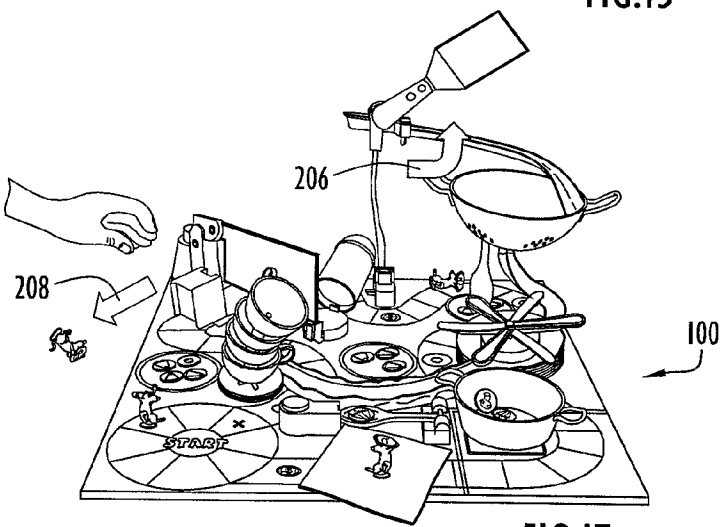

In FIG. 17, the salt shaker component 113 actuates the tab 178 on the base of the spatula 176 component, causing the spatula blade to swing upward as indicated by arrow 206. This view also shows the red player mover 132 separated from the game board as indicated by arrow 208.

Figure 18:
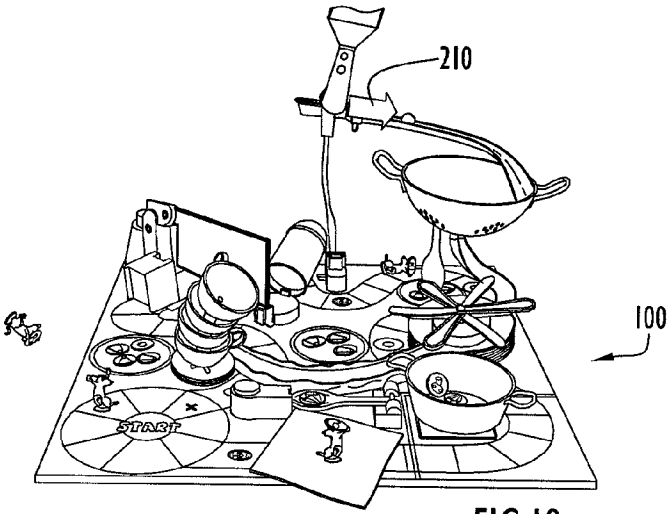

In FIG. 18, the swinging of the spatula blade to an upright orientation releases a ball bearing 181 as indicated by arrow 210, which rolls down a first curved ramp toward the strainer component 118.

Figure 19:
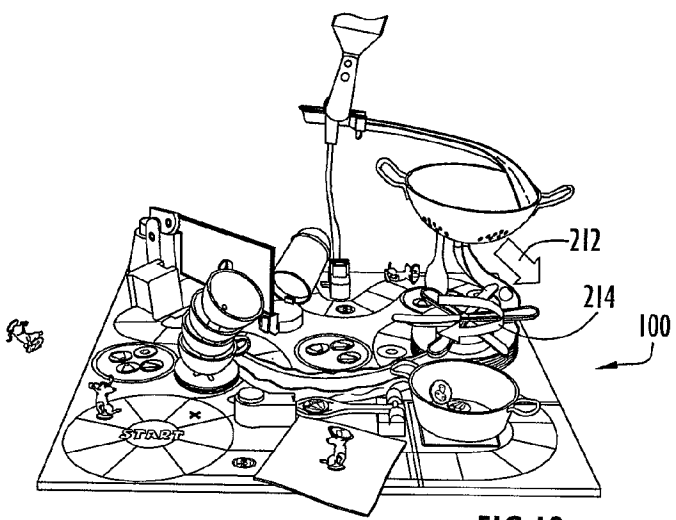

In FIG. 19, the ball bearing exits the bottom of the strainer as indicated by arrow 212, and rolls down a portion of curved ramp 180 (as indicated by arrow 214) to engage the knives 128 atop the stack of dishes component 129, causing the knives to pivot.

Figure 20:
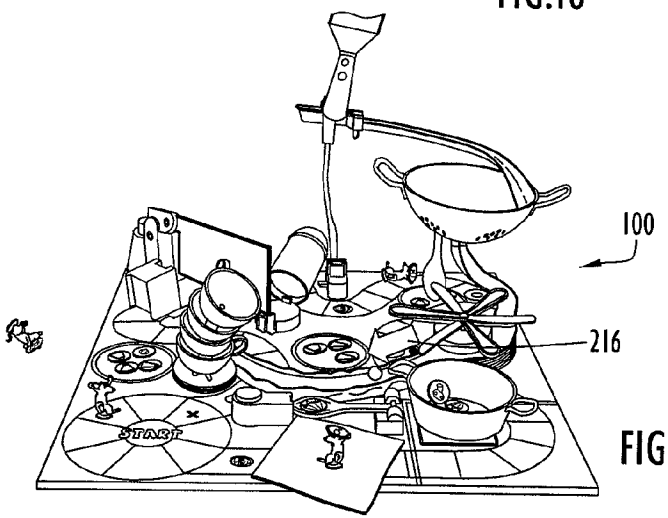

In FIG. 20, the ball bearing continues past the stack of dishes on another portion of curved ramp (as indicated by arrow 216) toward the stack of cups component 120. The knives 128 continue to spin until friction brings the spinning portion to rest.

Figure 21:
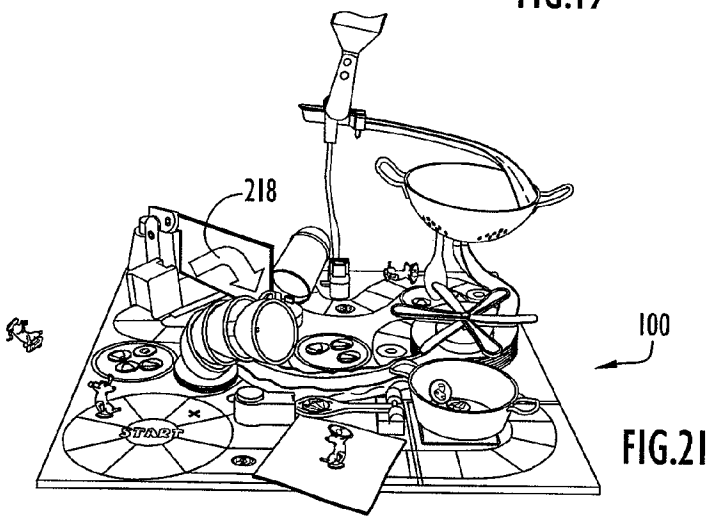

In FIG. 21, the ball bearing rolls from the curved ramp into the collection area adjacent the stack of cups component, triggering the stack to fall toward the terminating unit as indicated by arrow 218. One token 130' is shown to be placed on the head of the spoon 126 portion of the terminating unit.

Figure 22:
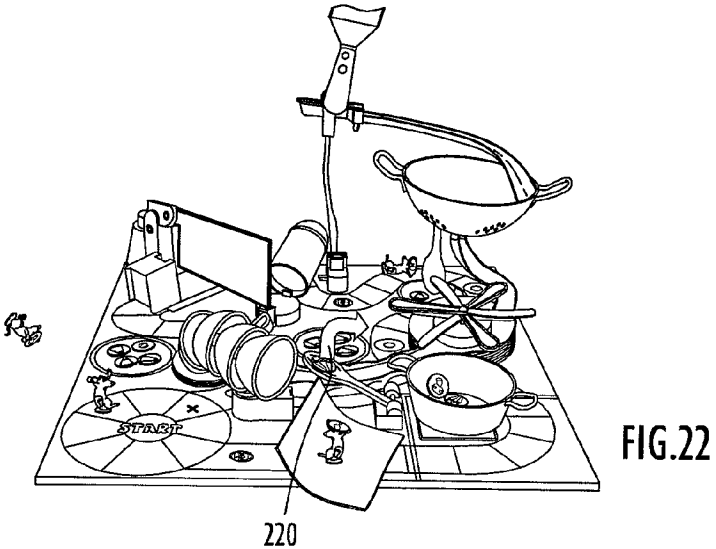

In FIG. 22, the stack of cups component engages the button trigger to actuate the terminating unit, causing the spoon portion 126 to swing upward as indicated by arrow 220. The towel portion 122 of the terminating unit, shown to lay across a portion of the pathway, is connected to the spoon portion, and is thus pulled from the pathway as the spoon portion swings upward.

Figure 23:
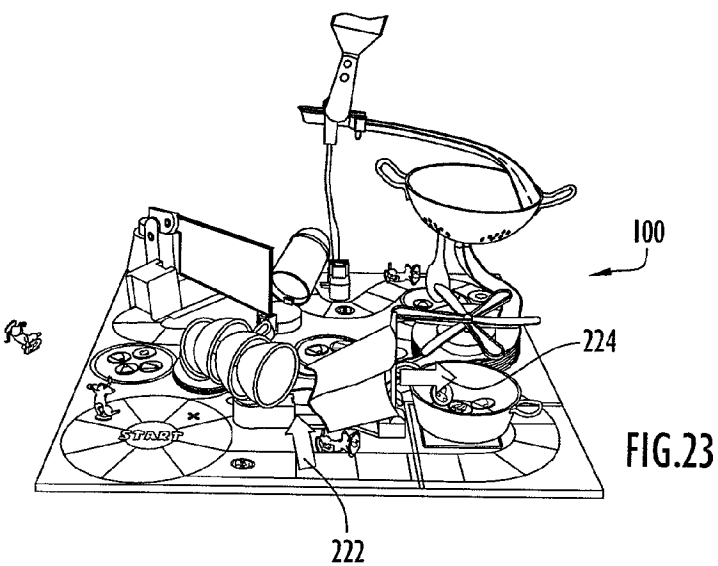

In FIG. 23, the blue player mover 136 is upturned as the towel portion 122 is pulled out from beneath the player mover, and the token mounted to the player mover is dislodged as indicated by arrow 222. Also, the token 130' in the head of the spoon is launched toward the target area in the form of a stewing pot 124 by the upward motion of the spoon portion as indicated by arrow 224.

Figure 24:
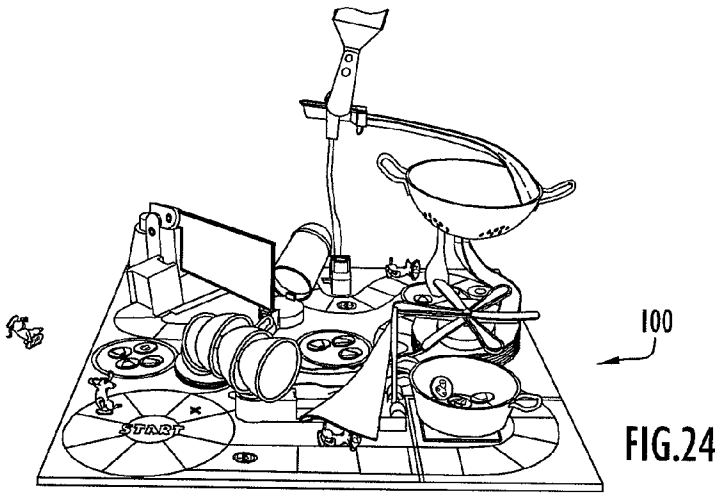

FIG. 24 shows the apparatus after the actuation of the terminating unit.

The foregoing paragraphs describe the actuation of the apparatus of the exemplary embodiment, but variations in the aforementioned game components and concepts are considered to be within the scope of the present disclosure. For example, some embodiments may include a plurality of independently actuable apparatus, each consisting of several operatively associated structural components. The actuable apparatus in some embodiments may be configured to be actuable by user as well as automatically actuable, and so forth.

An exemplary, non-limiting method of game play utilizing the components and concepts discussed above is outlined in the paragraphs below. Games may be played by two or more players, each of which controls a player mover and attempts to deliver two tokens from various token collection areas to the spoon portion of the terminating unit.

Prior to game play, the various structural components are constructed and/or detachably secured to the game board as detailed above, and are each set to be actuated. Each player chooses a player mover, and the tokens are distributed among the token collection areas. According to an exemplary set of rules for game play, five tokens are distributed face-down to each of four token collection areas, so that each token collection area includes one of each color of token, and a token with Chef Skinner indicia.

After a player is selected to take the first turn, a movement device is used to indicate the number of spaces the player may move his or her player mover, beginning at the movement space marked "START." For example, the aforementioned exemplary set of rules may call for the use of a die to indicate the number of spaces to move.

As a player mover traverses the pathway, if it is placed on a movement space bearing token indicia, the player controlling the player mover may attempt to collect a token by turning over a selected token in the closest token collection area. The set of rules may provide that a token may be collected in this manner only if the color of the selected token matches that of the player mover. The rules may also provide that a player is given two attempts to collect a token every time the player's player mover lands on a token space. The rules may also provide that if the Chef Skinner token is selected, the trigger on the trip unit is pressed a predetermined number of times, potentially actuating the apparatus.

If a token is successfully collected, a player mounts the token to his or her player mover and continues to move the player mover toward the terminating unit, while attempting to avoid the player mover "dropping" the token or being knocked over due to actuation of the apparatus.

If the apparatus is actuated, such as via the trigger and the random actuation mechanism or via the override button, the rules may provide that any player mover that is dislodged is assessed a penalty, such as retrograde movement of the mover backward on the pathway to a designated space. The rules may also provide that the apparatus is re-set after having been actuated.

Players generally continue in this manner, attempting to deliver token individually to the terminating unit. The rules may provide that a player may not unload a token into the spoon portion of the terminating unit, or leave the short pathway loop near the terminating unit, until the player mover is moved to a space bearing certain indicia, such as the spoon indicia visible on some of the movement spaces of FIG. 2. The rules may also provide that when a player successfully delivers a token to the spoon portion, the apparatus may be actuated by pressing the override button on the trip unit to launch the token into the cooking pot.

The rules may provide that the first player to successfully collect and deliver two tokens in this manner is the winner.

Several aspects of the exemplary methods of game play may be modified from that disclosed above, and these methods and/or modifications may be reflected in a set of rules to accompany the game. An exemplary set of rules, for example which may accompany a commercial embodiment similar to those described above, is reproduced below. The exemplary set of rules incorporates a lexicon that reflects the aforementioned theme of the "RATATOUILLE" animated film, and thus may be different from, but not inconsistent with, the concepts and components described above.

Remy's Kitchen Quake Game

Product description 2-4 players

Ages 5+

It's a race, a dangerous race across a disaster ridden counter top . . . where you are Remy! Be the first player to add 2 ingredients to the soup and win the game. But it's not that easy, Chef Skinner is on the prowl and he will set off a chain of disasters before he let's Remy cook in his kitchen.

Contents:

1 Board

4 Remy movers

20 Playing tokens (16—ingredient tokens/4 Chef Skinner tokens)

1 Die

Various props/mechanisms (butcher knife, bread, salt shaker, fork, spatula, strainer, 3 ramps, plates w/rotating knives, tea cups, spoon launcher w/dish towel, soup pot.)

Object: Be the first player to add two ingredients of your color into the soup.

There are 16 ingredient tokens in total, 4 of each type of ingredient including onions, broccoli, carrots, and chicken. Each type of ingredient has a colored background. Broccolis have yellow background, onions have red backgrounds, chickens have blue backgrounds, and carrots have green backgrounds. The colored backgrounds correspond to the color of each player's mover. Each player may collect only 1 type of ingredient. (The blue player will only be collecting chicken, the yellow player only broccoli)

You may only collect 1 ingredient at a time. Players may not collect a $2^{nd}$ ingredient until their first is successfully added to the soup!

Set Up:

Find the 4 plates illustrated on the game board. These plates represent the ingredient "pick-up" areas. Before play begins all 20 tokens must be distributed to the 4 "pick-up" areas. There will be 5 tokens on each plate when you are done. (4 ingredient tokens and 1 Chef Skinner token) Distribute the ingredients evenly to each "pick-up" area by placing one of each ingredient type face down on each plate. Then place 1 Skinner token face down on each plate. Make sure to mix them up so you don't know what's what.

After set-up each plate should have 1 broccoli, 1 chicken, 1 onion, 1 carrot and 1 Skinner.

Place all the movers on the start space which is located inside the launching loop.

First player to yell out their favorite food goes first.

Let's Play:

Roll the die and move around the board to the 4 "Pick-Up" areas. When you land at a pick-up space, those with plate icons, turn over a token of your choice. You do not need an exact roll to land on a pick up space.

- If it's your ingredient, background color matching your mover's color, slide the token into Remy's hands. Once you've collected an ingredient, you can not loose it.
- If it's an opponent's ingredient, place the token back on to the plate face down. On your next turn you must keep moving forward to the next plate and try again. Better luck next time!

Players should pay attention to what tokens are being turned over. It could help you out!

Turning over a Chef Skinner Token

- If it's a Chef Skinner token you may be in trouble. Each Skinner token shows a number value. Press the button on the butcher knife as many times as shown on the token. You never know how many presses it will take to set off the butcher knife!
  - If the knife does not fall you're safe! Phew. Place the Skinner token back onto the plate face down. Mix up the ingredients on the plate after a Skinner token has been revealed.
  - If the knife does fall, setting off the chain reaction, watch out! You may be in trouble. Allow the chain reaction to make a complete cycle, ending with the spoon launcher. Now assess the damage.
    - If your Remy mover was knocked over by the chain reaction, move him backwards on the path to the closest penalty space.
      Penalty Spaces are designated by an "x".
    - If your mover remains standing, you're safe. You do not have to move backwards.

Chain Reaction Sequence:

When a player either lands on a Skinner Space or turns over a Skinner Token he/she must press the Butcher Knife button as many times as the value shows.

Inside the butcher knife is a randomizing mechanism . . . you never know how many compressions it will take to trigger!

The Butcher Knife falls chopping the bread in half, sending any mouse on the bread or on the near by path flying. The knife hits the Salt Shaker, tipping it over into the Spatula Pendulum. Once hit by the salt, the spatula spins around releasing 1 Ball Bearing which rolls down the ramp and into the Strainer. The ball spirals down the Strainer and is washed away onto the plate below and into the Rotating Knives. The ball continues to roll down the water stream ramp into the cups. The Tea Cups are triggered by the ball which then falls on to the Spoon launcher. If there is an ingredient on the Spoon Launcher it will be launched into the Soup Pot. Hopefully your opponent is standing on the Dish Towel which is attached to the launcher, if they are, the launch will upset the dish towel sending their mouse flying!

Danger Zones:

1. Bread spaces and surrounding path.
2. Salt Shaker
3. Swinging Spatula
4. Rotating Knives—knock you over
5. Water Stream spaces—dangerous rolling ball!
6. Dish Towel spaces
7. Falling Cups Chef Skinner Spaces.

Chef Skinner spaces work the same as the Skinner tokens. Each Skinner space shows a numerical value. When a Skinner space is landed on, press the butcher knife button as many times as shown on the space. Resolve the action accordingly.

As with the "pick-up" spaces, a player does not need an exact roll to land on a Skinner space. They may choose to end their movement short in hopes of affecting their opponents.

The Launching Loop

Inside the launching loop, and only in the launching loop, can players unload their ingredient into the spoon and launch it into the soup.

A player must launch their ingredient into the soup before he/she can leave the launching loop. Players must roll the die and move around the loop until they land on a Spoon Space.

Landing on a Spoon Space

When a player lands on a spoon space by exact count, they may then take the token from Remy's hands and place it into the spoon launcher. Once their ingredient is loaded onto the spoon that player may set off the chain reaction by pressing the override button on the butcher knife!

Player's may leave the launching loop to pick up their second and final token once their ingredient is in the soup Winning the Game:

Win the game by being the first player to add two ingredients to the soup.

Optionally, as mentioned above, the configuration of the game components may be modified to achieve a desired effect, in conjunction with the game rules. The apparatus and/or rules of the game may thus provide game play with a desired degree of complexity or difficulty, for example to adapt the game to players of a predetermined age range, and/or to adjust the relative degrees to which chance and strategy determine the winner of the game.

The exemplary embodiments and methods illustrated and disclosed herein are believed to encompass multiple distinct inventions with independent utility. While each has been disclosed in an exemplary form, the specific embodiments thereof as disclosed and illustrated herein are not to be considered in a limiting sense as numerous variations of the concepts and components are possible. The subject matter of the inventions includes all novel and non-obvious combinations and subcombinations of the various elements, features, functions and/or properties disclosed herein. Similarly, where any description recites "a" or "a first" element or the equivalent thereof, such description should be understood to include incorporation of one or more such elements, neither requiring nor excluding two or more such elements.

Inventions embodied in various combinations and subcombinations of features, functions, elements, and/or properties may be claimed through presentation of claims in a related application. Such claims are also regarded as included within the subject matter of the inventions of the present disclosure.

What is claimed is:

1. A game comprising:

a game board including a pathway with a plurality of spaces;

a first structural component coupled to the game board at a first location, the first structural component including a base portion, the base portion being coupled to the game board, the first structural component including a first actuatable mechanism and a first trigger, the first actuatable mechanism being movably coupled to the first structural component and movable between a first position and a second position, the first trigger being connected to the first actuatable mechanism, actuation of the first trigger causing the first actuatable mechanism to move from its first position to its second position; and a second structural component being coupled to the game board at a second location spaced apart from the first location, the second structural component including a base portion coupled to the game board, the second structural component including a second actuatable mechanism and a second trigger, the second actuatable mechanism being movably coupled to the second structural component and movable between a first position and a second position, the second trigger being connected to the second actuatable mechanism, the first actuatable mechanism contacts the second trigger when the first actuatable mechanism is its second position, thereby causing the second structural component to move from its first position to its second position, and a portion of the pathway traverses at least one of the first structural component and the second structural component, wherein the first structural component includes a random actuation mechanism connected to the first trigger, the random actuation mechanism causing user operation of the first trigger of the first structural component to result randomly in the actuation of the first actuatable member.

2. The game of claim 1, wherein the game board has a first hole and a second hole, the game further comprising:

a first connector device coupled to the base portion of the first structural component, the first connector device being attached to the game board via the first hole; and a second connector device coupled to the base portion of the second structural component, the second connector device being attached to the game board via the second hole.

3. The game of claim 1, wherein each of the first structural component and the second structural component is in the shape of a kitchen utensil.

4. The game of claim 1, wherein the path of the game board is partially formed across the first structural component and the second structural component.

5. A game, comprising:

a game board having a path defined thereon;

a first structural component being coupled to the game board, the first structural component including a first actuatable mechanism and a first trigger, the first actuatable mechanism being movably coupled to the first structural component and movable between a first position and a second position, the first trigger being connected to the first actuatable mechanism, the first actuatable mechanism moving from its first position to its second position in response to actuation of the first trigger, the first structural component including a random actuation mechanism operatively coupled to the first trigger so that the actuation of the first trigger randomly results in movement of the first actuatable mechanism; and a second structural component being coupled to the game board, the second structural component including a second actuatable mechanism and a second trigger, the second actuatable mechanism being mounted for movement between a first position and a second position, the second trigger being connected to the second actuatable mechanism, movement of the first actuatable mechanism to its second position results in the first actuatable mechanism engaging the second trigger and thereby causing movement of the second actuatable mechanism from its first position to its second position.

6. The game of claim 5, wherein the second actuatable mechanism includes a first portion and a second portion, the first portion and the second portion being disposed proximate to each other in a first configuration and moved away from each other when the second trigger is engaged by the first structural component.

7. The game of claim 5, further comprising:

a third structural component, the third structural component being supported by the game board, the third structural component including a third actuatable mechanism and a third trigger connected to the third actuatable mechanism, the third actuatable mechanism being mounted for movement between a first position and a second position, the third actuatable mechanism moving from its first position to its second position in response to actuation of the third trigger.

8. The game of claim 7, wherein the second actuatable mechanism engages the third trigger when the second actuatable mechanism moves from its first position to its second position.

9. The game of claim 7, wherein each of the movement of the first actuatable mechanism, the movement of the second actuatable mechanism, and the movement of the third actuatable mechanism is different from the movement of the other actuatable mechanisms.

10. The game of claim 7, wherein movement of the second actuatable mechanism includes movement of a first portion of the second actuatable mechanism in a first direction and movement of a second portion of the second actuatable mechanism in a second direction different than the first direction.

11. The game of claim 10, wherein the second portion of the second actuatable mechanism engages the third trigger of the third structural component.

12. The game of claim 7, wherein the trigger of one of the first structural component, the second structural component, and the third structural component is located between movable portions of the particular structural component.

13. The game of claim 12, wherein the trigger of one of the first structural component, the second structural component, and the third structural component projects outwardly from the particular structural component.

14. The game of claim 5, wherein the path traverses at least one of the first structural component and the second structural component.

15. A game, comprising:

a game board, the game board having a path defined thereon;

a first structural component being coupled to the game board, the first structural component including a movable portion and a trigger operably connected to the movable portion, the movable portion being coupled to the first structural component for movement between a first position and a second position, the movable portion moving from its first position to its second position in response to actuation of the trigger;

a second structural component being coupled to the game board, the second structural component including a movable portion and a trigger operably connected to the movable portion of the second structural component, the movable portion of the second structural component being coupled to the second structural component for movement between a first position and a second position, the trigger of the second structural component being located at the second position of the movable portion of the first structural component; and a third structural component being coupled to the game board, the third structural component including a movable portion and a trigger operably connected to the movable portion of the third structural component, the movable portion of the third structural component being coupled to the third structural component for movement between a first position and a second position, the trigger of the third structural component being located at the second position of the movable portion of the second structural component, wherein the path traverses at least one of the first structural component, the second structural component, and the third structural component, wherein the first structural component includes a random actuation mechanism operatively coupled to the trigger of the first structural component so that the actuation of the trigger of the first structural component randomly results in movement of the movable portion of the first structural component from its first position to its second position.

16. The game of claim 15, wherein movement of the first structural component movable portion to its second position results in the engagement of the first structural component movable portion with the second structural component trigger, which causes movement of the second structural component movable portion from its first position to its second position.

17. The game of claim 16, wherein movement of the second structural component movable portion to its second position results in the engagement of the second structural component movable portion with the third structural component trigger, which causes movement of the third structural component movable portion from its first position to its second position.

18. The game of claim 16, wherein the movement of the first structural component movable portion from its first position to its second position is different than the movement of the second structural component movable portion from its first position to its second position, which is different than the movement of the third structural component movable portion from its first position to its second position.

* * * * *